US005573067A

United States Patent [19]

Fiterson

[11] Patent Number: 5,573,067

[45] Date of Patent: Nov. 12, 1996

[54] APPARATUS FOR EXTINGUISHING AN OIL WELL FIRE

[76] Inventor: Naum Fiterson, 2823 W. 12th St. Apt. 15H, Brooklyn, N.Y. 11224

[21] Appl. No.: 317,714

[22] Filed: Oct. 4, 1994

[51] Int. Cl.[6] ..... A62C 3/06

[52] U.S. Cl. ..... 169/52; 169/28; 169/69

[58] Field of Search ..... 169/28, 51, 52, 169/69; 220/420, 425, 454

[56] References Cited

U.S. PATENT DOCUMENTS

| | | | |
|---|---|---|---|
| 695,847 | 3/1902 | Van Valkenburg et al. | 169/28 |
| 1,453,091 | 4/1923 | Delbare | 169/28 |
| 3,086,465 | 4/1963 | De Montfort | 169/69 X |
| 4,337,831 | 7/1982 | Thaxton | 169/69 |
| 4,343,413 | 8/1982 | Chatzipetros et al. | 220/425 |
| 4,433,733 | 2/1984 | Cunningham | 169/69 X |
| 4,854,389 | 8/1989 | Warren et al. | 169/28 |
| 5,146,995 | 9/1992 | Kim | 169/69 X |
| 5,207,779 | 5/1993 | Chaplinski | 169/69 X |

*Primary Examiner*—Andrew C. Pike
*Attorney, Agent, or Firm*—Michael I. Kroll

[57] ABSTRACT

Apparatus for extinguishing an oil well fire includes a platform which is maneuvered by helicopters into a position centered on the well casing. A radial slot formed in the platform guides the casing to pass to the center of the platform. A latch secures the platform around the casing. The platform supports a plurality of dewar tanks containing liquid helium. Each dewar tank has a remotely controlled release device. In the preferred embodiment, this release device comprises an explosive charge, but in other embodiments may be a remotely controlled valve. At least three cables, attached to the platform in circumferentially spaced apart relation, enable an equal number of helicopters to move the platform stably. The platform is preferably made from titanium. The cables are steel sheathed in insulating material. When used, the device is maneuvered onto the well casing, and a remote signal releases the helium. The helium absorbs heat and expands. This both asphyxiates the fire, and chills the well apparatus below the temperature of spontaneous autoignition.

8 Claims, 2 Drawing Sheets

APPARATUS FOR EXTINGUISHING AN OIL WELL FIRE

BACKGROUND OF THE INVENTION

1. Field of the Invention

The present invention relates to apparatus and a method for extinguishing oil well fires. More particularly, a source of cryogenic, inflammable material is brought into close proximity to the well and released. The flame is asphyxiated, and sufficient heat energy is absorbed so that immediate autoignition is prevented.

2. Description of the Prior Art

Numerous innovations for methods and apparatus for exhausting oil well fires have been provided in the prior art. A recent example of the need for an apparatus for extinguishing oil well fires arose during the Persian Gulf War of 1991. During this episode, as many as seven hundred oil wells in Kuwait were intentionally set on fire. These wells resisted the efforts of specialists in getting them under control. The usual difficulties in controlling oil well fires were compounded by environmental conditions inherent in the desert area of Kuwait. One of the environmental conditions which complicated the controlling of the oil well fires is the limited water supply of the area. A second complication resulting specifically from the war in the Persian Gulf is that experts were only allowed limited use of heavy machinery due to the presence of land mines in the area.

Burning oil wells, generally, if out of control, can create serious damage to land, property, water supplies, and the air. The burning oil wells of Kuwait are thought to have affected the environment.

On other occasions, oil wells have caught on fire unintentionally. Regardless of the cause of the fire, a need remains for an apparatus for extinguishing oil well fires. The ideal apparatus for extinguishing oil well fires is very safe, quick, and efficient to use in situations when there is limited water supply or limited use of heavy machinery or in the event that both circumstances exist.

A nozzle assembly for lowering onto a burning well or associated structure is seen in U.S. Pat. No. 5,146,995, issued to Hilton S. Kim on Sep. 15, 1992. A suitable fluid is discharged from the nozzle assembly for suppressing the fire. The inventor suggests that the invention be lowered into place, as from a crane or the like. This procedure would not be available in environments such as those existing in Kuwait, and may be limited to those situations in which a crane or similar apparatus preexists, and is so located as to center the apparatus over the flame. There is no suggestion in this patent of dispensing a cryogenic material from the novel apparatus, nor of remote control of release of the fire suppressing agent.

U.S. Pat. No. 4,337,831, issued to Darrel G. Thaxton on Jul. 6, 1982, illustrates apparatus for storing and releasing a fire suppressant from a plurality of storage containers. This device cooperates closely with a bell nipple of a blowout preventer of an oil well. Since maneuvering such apparatus into place on a burning well would be nearly impossible given the extreme temperatures, fast moving flame or jet of gasses, and the characteristic dark, opaque, toxic smoke released during a well fire, this apparatus is best suited for assembly prior to a fire. Again, there is no suggestion of employing a cryogenic fire suppressant, nor of remote control of the releasing of fire suppressant.

A device intended for maneuvering into position around a well pipe for subsequent fire suppression is described in U.S. Pat. No. 5,207,779, issued to Charles Chaplinski on May 4, 1993. The device is dragged horizontally from one direction into operative engagement with the well casing, rather than being airlifted, as in the present invention. More significantly, the device of Chaplinski crushes the well casing or pipe under hydraulic pressure acting as on a ram or jaw. No fire suppressing material is delivered to the fire site or is released. The use of cryogenic fire suppressant is not suggested in this patent. Although operation of the device is remote, in the sense that hydraulic lines may extend therefrom to a distant control station or source of pressure, control is limited by the reach of these lines, and is dependent upon the lines remaining in good condition. Kinking, crushing, twisting, and other distortions of the lines would defeat successful operation of the device.

A snuffing device is seen in U.S. Pat. No. 4,433,733, issued to Byron H. Cunningham on Feb. 28, 1984. The snuffer is lowered into place over the burning well or oil tank. No fire suppressing agent is released. The same difficulties in lowering the device effectively over the burning structure as set forth in the above discussion of Thaxton would occur in employing the device of Cunningham. There is no remotely operated device.

None of the above inventions and patents, taken either singly or in combination, is seen to describe the instant invention as claimed.

SUMMARY OF THE INVENTION

The present invention provides a device which can be maneuvered into place onto a burning oil well despite the difficult conditions listed above. The device is airborne, so that even in the unlikely event that the land has been mined, the fire suppression operation can proceed.

The apparatus need not remain in good condition to be effective, and will even operate if completely destroyed by flames and heat. The remote control system is truly remote, in that there is no communication line, hydraulic line, cable, or solid link of any kind extending outside the apparatus. Even in the event that the remote controller fails, the novel apparatus is such that sufficient heating will deploy it.

Extinguishing is accomplished by releasing an inflammable cryogenic liquid, which evaporates into a gas. Two effects ensue from the selection of the cryogenic liquid as a fire suppressant. The first is that a relatively compact mass expands into a blanket of relatively great volume which displaces oxygen, thus extinguishing the flame. The second is that the initial temperature of the fire suppressant is extremely low, which, combined with the endothermic process of evaporation, lowers the temperature of the oil well apparatus below the autoignition threshold of hydrocarbons. Therefore, the flame is extinguished, and the environment is sufficiently cool to prevent spontaneous regeneration of the flame.

The apparatus includes a platform having a radial slot, for guiding the platform to a position centered on the oil well casing. At least three cables are attached to the platform, spaced sufficiently apart to enable an equal number of helicopters to lift the platform and maneuver it into the centered position.

A plurality of dewar tanks are secured to the platform. Each tank is filled with liquid helium, and has remotely controlled release apparatus connected thereto. In a preferred embodiment, the release apparatus includes an explosive charge. This is not objectionable, since destruction of the fire extinguishing device will result in releasing the cryogenic liquid. The economic benefits of suppressing a large scale well fire greatly exceeds the cost of that portion of the fire extinguishing device proximate the flame.

In a second embodiment, the release apparatus comprises a solenoid operated valve. In both embodiments, the release apparatus is radio operated, and each receptacle has its own release apparatus. This arrangement removes dependence of successful operation from reliance upon wires, cables, fluid pressure lines, and other solid devices which could be damaged in the haste, heat, and generally destructive nature of the task at hand. Provision of individual release apparatus enables selective release of cryogenic fluid.

The platform is preferably made from titanium, since this material is much lighter than steel, yet is strong, and also has a very high ignition point. The cables for suspending the platform from the helicopters are preferably steel sheathed in a heat insulating material.

Satisfactory storage receptacles for liquid helium are provided by double walled, silvered dewar tanks. The space between the double walls is evacuated. The vacuum enclosing, doubled walled, silvered construction minimizes transmissivity of heat. This prolongs the effective life of liquid helium to the maximum extent which is feasible given the nature of the apparatus and the problem solved thereby.

Accordingly, it is a principal object of the invention to provide an apparatus for extinguishing an oil well fire.

It is another object of the invention to enable stable airborne maneuvering of the apparatus into place on the burning oil well.

It is a further object of the invention to both extinguish the flame and simultaneously cool the oil well so as to prevent spontaneous autoignition.

It is an additional object of the invention to operate the apparatus remotely.

It is again an object of the invention to latch in a central position on the oil well.

Another object of the invention is to fabricate the apparatus to be light and heat resistant.

Yet another object of the invention is to store the cryogenic liquid in a receptacle which minimizes heat transmissivity.

Still another object of the invention is to enable release of the cryogenic liquid from selected receptacles.

It is an object of the invention to provide improved elements and arrangements thereof in an apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
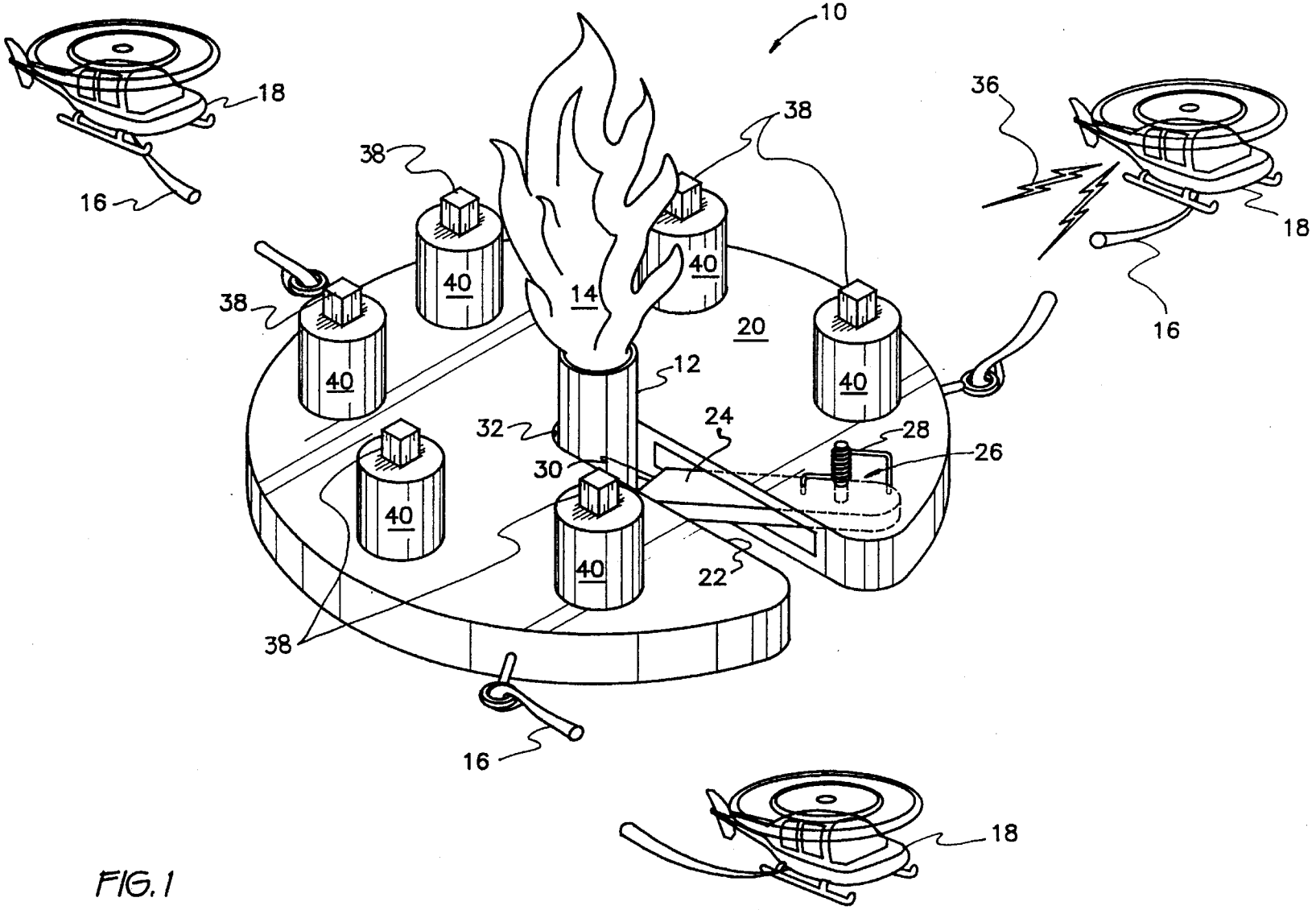
FIG. 1 is a diagrammatic, perspective, environmental view of the invention.

Throughout this specification, the following reference numerals are employed to refer to the following elements.

| | |
|---|---|
| 10 | apparatus for extinguishing an oil well fire |
| 12 | well casing |
| 14 | flame |
| 16 | cables |
| 18 | helicopters |
| 20 | platform of apparatus 10 |
| 22 | slot in platform |
| 24 | arm |
| 26 | pivot point of arm |
| 28 | spring |
| 30 | end of arm |
| 32 | throughbore |
| 34 | directional arrow (FIG. 2) |
| 36 | radio signal |
| 38 | release devices |
| 40 | dewar tanks |
| 42, 42' | silvered walls of dewar tanks |
| 44 | directional arrow (FIG. 4) |

The novel apparatus 10 for extinguishing an oil well fire is shown in FIG. 1 in its environment. The environment includes an oil well, represented by well casing 12, and a jet of hot gasses and flame, represented generally at 14. In a real oil well fire, a considerable volume of opaque and toxic smoke is generated, which in this view is omitted for clarity. The conditions brought about by the presence of heat, flame, smoke, toxic gasses, and violent air currents renders the task of setting any fire control apparatus in place difficult and hazardous.

The present invention accommodates this situation in large part because that portion of apparatus 10 engaging the well is suspended from cables 16 attached to helicopters 18. Helicopters provide one form of airborne lifting of maneuvering apparatus 10. This is desirable since no crane or other ground supported lift need be maneuvered into place in the harsh environment of an oil well fire.

The length of cables 16 is determined by the size of the flame and severity of the conditions. Preferred construction of cables 16 is steel, sheathed in insulation material.

The helicopters are able to maintain a safe distance from the fire and violent air currents, and manipulation of apparatus 10 is thus expedited.

The portion of apparatus 10 which directly engages casing 12 is a flat platform 20, preferably made from titanium, for light weight yet great strength. Platform 20 has a radial slot 22 for engaging casing 12 by surrounding the same, as shown in FIG. 1. An arm 24 enables platform 20 to latch to the vertical casing 12 by the following arrangement.

Figure 2:
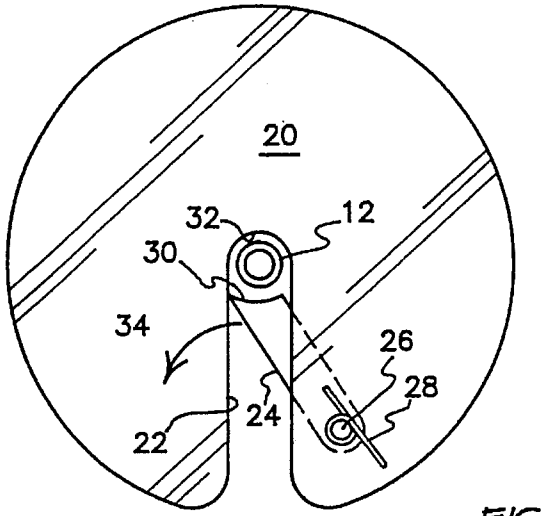
FIG. 2 is a top plan detail view of the component of the invention surrounding the oil well, illustrating in particular the latching arrangement securing this component to the yell, drawn to enlarged scale.

Arm 24 is pivotally mounted to platform 20, as indicated generally at 26. A spring 28 biases arm 24 into a position obstructing groove 22. The force of spring 28 is overcome when maneuvering platform 20 into place. Due to the arrangement of arm 24, as seen in FIG. 2, maneuvering platform 20 past casing 12 pushes arm 24 effectively aside. When casing 12 passes end 30 of arm 24, thus reaching a central throughbore 32, arm 24 springs back to its position obstructing slot 22. Slot 22 communicates between throughbore 32 and the exterior of platform 20, and guides platform 22 to a position centered about casing 12.

Should platform 20 be moved to cause casing 12 to bear against end 30 of arm 24, a component of force urges arm 24 in the direction of arrow 34. This holds arm 24 in the position shown in this Drawing Figure, thus maintaining slot 22 obstructed. Therefore, platform 20 remains latched or secured in the centered position about casing 12.

Again referring to FIG. 1, when platform 20 is latched in place about casing 12, a fire suppressing material is released to combat the flame. A plurality of receptacles storing a cryogenic, inflammable fluid are secured to platform 20. A remote signal, represented by radio signal 36, causes a release device 38 to release the fluid to the atmosphere. Release device 38 includes a valve and is shown schematically in FIGS. 1 and 3.

A preferred fluid is liquid helium. This substance is light, inflammable, extremely cold, and is a gas at ambient pressures and temperatures above the ignition threshold temperature of hydrocarbons. When released, the helium evaporates into the gaseous state, and is drawn into the upwardly flowing column of combustion gasses. Due to the great increase in volume as liquid helium becomes gaseous, oxygen is substantially displaced from proximity with the hydrocarbon fuel, and the flame is extinguished.

Simultaneously, the glowing hot metal components of the oil well are chilled below the ignition threshold temperature. Thus, spontaneous regeneration of the flame is prevented. Regeneration of the flame is a natural consequence of the temperatures present even when a flame is extinguished, should the supply of oxygen not continue to be displaced.

Figure 3:
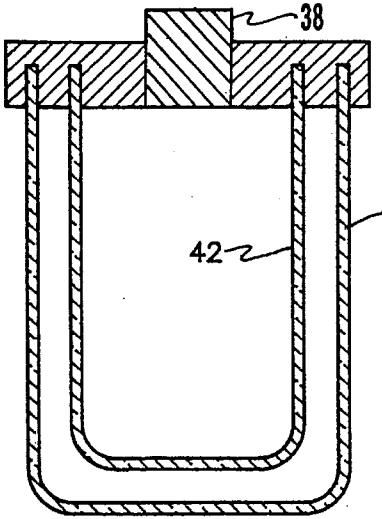
FIG. 3 is a side cross sectional detail view of a dewar tank for storing liquid helium.

As seen in FIG. 3, the fluid storage receptacles are preferably double walled dewar tanks 40 having silvered walls 42 and 42'. Space between inner wall 42 and outer wall 42' is evacuated to reduce heat transmissivity. This type of receptacle can store liquid helium satisfactorily for the conditions and time duration required to suppress a fire. Dewar tanks 40 also cooperate with release devices 38 (see FIG. 1).

In a preferred embodiment, the release devices 38 are radio controlled units that include an explosive charge. Radio signal 36 detonates the explosive charge, destroying dewar tank 40 and releasing the helium contained therein. In a second embodiment, the release devices 38 are radio controlled valves. Each dewar tank 40 has an individual, dedicated release device 38.

Figure 4:
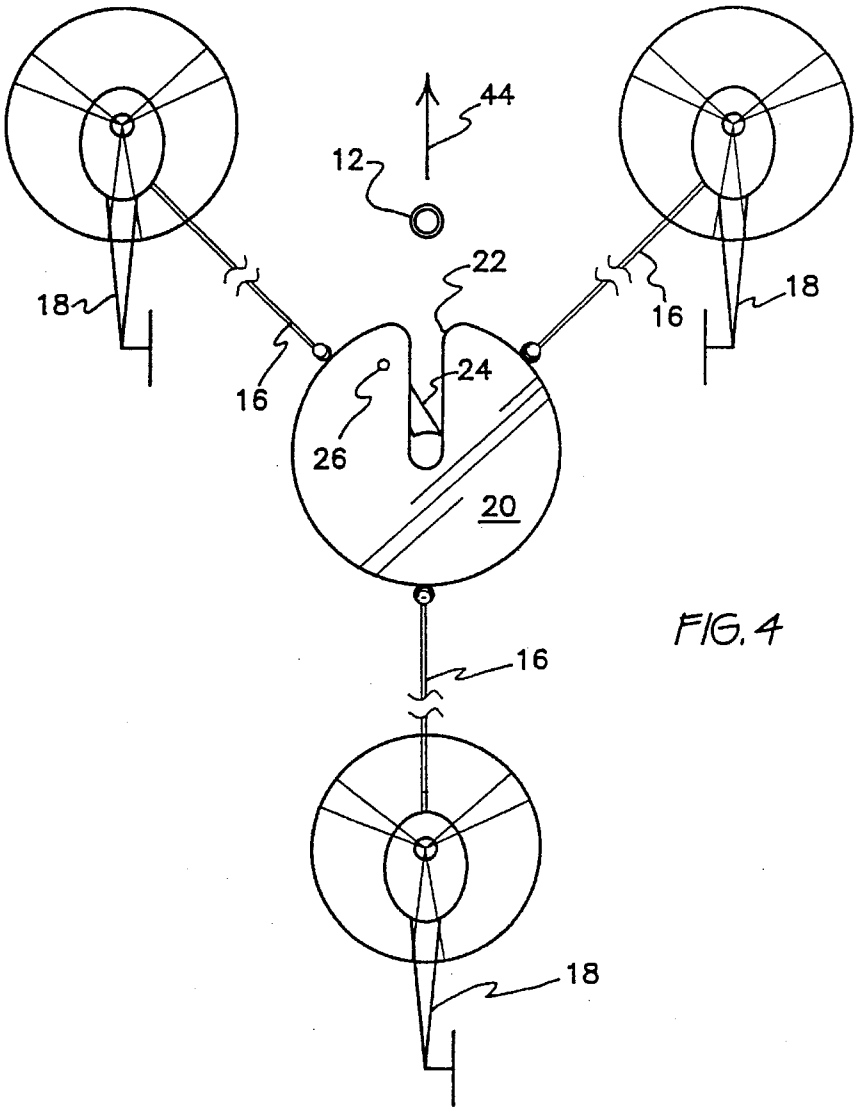
FIG. 4 is an environmental, top plan, diagrammatic view illustrating a preferred mode of use of the invention.

Referring now to FIG. 4, there are three cables 16 attached to platform 20, spaced apart from one another at their respective points of attachment. Helicopters 18 are arranged to the right, to the left, and behind platform with slot 22 facing forwardly, indicated by arrow 44. This arrangement enables all helicopters 18 and also platform 20 to maneuver without having to pass directly over the burning oil well. When platform 20 latches into place about the oil well, the remote radio signal can be given, and the fire will be extinguished.

It is to be understood that the present invention is not limited to the embodiments described above, but encompasses any and all embodiments within the scope of the following claims.

I claim:

1. An apparatus for extinguishing an oil well fire, said apparatus comprising:

means including cables for supporting a platform for engaging and latching to an outside of a vertical tube of an oil well from which flames and hot gasses are jetting, said platform comprising a flat solid member of lightweight metal having a central opening for surrounding said vertical tube and a radial slot extending outwardly from said central opening to permit said platform to be maneuvered into place for being positioned with said vertical tube passing through said central opening extending above said platform with a top opening of said vertical tube remaining uncovered, said slot including means for automatically locking said vertical tube in said central opening after said locking means slides past said tube, said cables being attached to said member along an outer edge thereof at points spaced apart from each other; and a plurality of storage receptacles surrounding said central opening mounted on and secured to said platform containing a cryogenic, inflammable fluid which is a gas at ambient pressures and temperatures above the ignition threshold temperature of hydrocarbons, said storage receptacles including remotely operated means for releasing said cryogenic, inflammable fluid from said receptacles into the atmosphere around the outside of said vertical tube to be drawn into the jetting flames and hot gasses for displacing oxygen from the oil well fire and simultaneously cooling the oil well below the ignition threshold temperature of hydrocarbons.

2. The apparatus according to claim 1 in which said releasing means comprises explosives.

3. The apparatus according to claim 1, further including airborne lifting means for lifting and maneuvering said platform into position through the air by said cables.

4. The apparatus according to claim 3, wherein said airborne lifting means comprises helicopters.

5. The apparatus according to claim 1, wherein each said storage receptacle comprises a dewar tank having double walls, a space between said walls being evacuated to reduce heat transmissivity, and said dewar tank being silvered to reflect heat.

6. The apparatus according to claim 5, wherein each said dewar tank has individual, dedicated release means for releasing said fluid.

7. The apparatus according to claim 6, wherein said fluid is liquid helium.

8. The apparatus according to claim 1, wherein said platform is made from titanium.

* * * * *